US005877685A

United States Patent [19]

Eriksson

[11] Patent Number: 5,877,685

[45] Date of Patent: Mar. 2, 1999

[54] INFORMATION CARRIER FOR MOVEMENT-RESPONSIVE SWITCH

[76] Inventor: Lennart Eriksson, Slåttervägen 80, Tyresö , Sweden

[21] Appl. No.: 525,776

[22] PCT Filed: Mar. 30, 1994

[86] PCT No.: PCT/SE94/00295

§ 371 Date: Sep. 27, 1995

§ 102(e) Date: Sep. 27, 1995

[87] PCT Pub. No.: WO94/23410

PCT Pub. Date: Oct. 13, 1994

[30] Foreign Application Priority Data

Mar. 30, 1993 [SE] Sweden ..... 9301062

[51] Int. Cl.[6] ..... G08B 13/08

[52] U.S. Cl. ..... 340/545; 340/572; 340/825.34

[58] Field of Search ..... 340/545, 541, 340/568, 825.31, 825.32, 825.34, 572; 235/375, 380, 382, 382.5, 385; 346/42, 33 R; 705/22, 28

[56] References Cited

U.S. PATENT DOCUMENTS

| | | | |
|---|---|---|---|
| 3,419,881 | 12/1968 | Yamamoto et al. | 346/42 |
| 3,792,493 | 2/1974 | Hughes | 346/42 X |
| 3,969,584 | 7/1976 | Miller et al. | 340/542 X |
| 4,717,816 | 1/1988 | Raymond et al. | 235/382.5 |
| 4,751,499 | 6/1988 | Chen | 340/547 |
| 4,797,663 | 1/1989 | Rios | 340/541 X |
| 5,097,253 | 3/1992 | Eschbach et al. | 340/545 |
| 5,189,396 | 2/1993 | Stobbe | 340/541 |
| 5,515,030 | 5/1996 | Citron et al. | 340/545 |

FOREIGN PATENT DOCUMENTS

| | | |
|---|---|---|
| 0 142 013 | 5/1985 | European Pat. Off. . |
| 0 170 559 | 2/1986 | European Pat. Off. . |
| 2 633 758 | 1/1990 | France . |

*Primary Examiner*—Thomas J. Mullen, Jr.
*Attorney, Agent, or Firm*—Nixon & Vanderhye P.C.

[57] ABSTRACT

A sealing method by means of which breaking of a seal is detected at least subsequently. The method is mainly characterized by recording breaking of the seal in a readable manner with the aid of an updatable information carrier (2). The invention also relates to a sealing arrangement.

13 Claims, 1 Drawing Sheet

INFORMATION CARRIER FOR MOVEMENT-RESPONSIVE SWITCH

BACKGROUND AND SUMMARY OF THE INVENTION

The invention relates to an assembly for detecting when a seal has been broken, e.g. a door opened or goods removed from a surface, and recording that event.

A seal in the meaning of an arrangement which is so constructed that a change in the state of the seal, such as the opening of a door or the dispatch of goods can be clearly detected subsequently is, of course, encumbered with serious problems, such as high costs and unreliability in operation.

The present invention relates to an arrangement by means of which an object can be sealed extremely reliably and with a high degree of flexibility at relatively low cost.

According to one aspect of the present invention an assembly is provided comprising the following components: A door mounted in, and for movement with respect to, a door frame. An electrical switch activated in response to movement of a portion of the door away from the door frame. And, an information carrier (e.g. smart card) mounted on said frame and recording each activation of the switch. The assembly may further comprise a clock unit mounted on the door frame for supplying the date and clock time to the information carrier for recordation thereof each time the switch is activated. The switch may comprise a permanent magnet activated switch mounted on the door frame, and a permanent magnet may be mounted on the door for cooperation with the switch. The door is hinged at a first side thereof and the magnet may be mounted on a second side of the door opposite the first side. The switch is mounted on the door frame adjacent the second side of the door. The information carrier can also record each deactivation of the switch.

An information carrier reader may be mounted in contact with the information carrier. Also an acknowledgment unit may be provided in contact with the information carrier for transmitting the identity of a person opening the door for recordation by the information carrier.

DETAILED DESCRIPTION OF THE DRAWINGS

Figure 1:
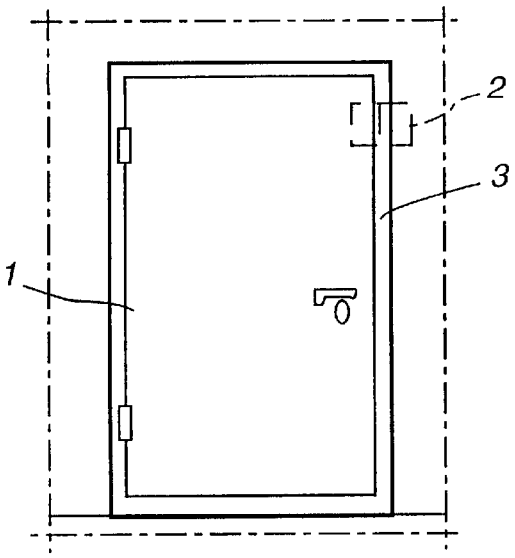
FIG. 1 illustrates schematically a door sealed in accordance with the invention.

FIG. 1 illustrates a door 1 which is sealed in accordance with the invention, wherein there is provided on the door frame 3 an updatable information carrier 2 which records in a readable manner breaking of the seal, which corresponds to opening of the door 1. The information carrier 2 is preferably a smart card.

Figure 2:
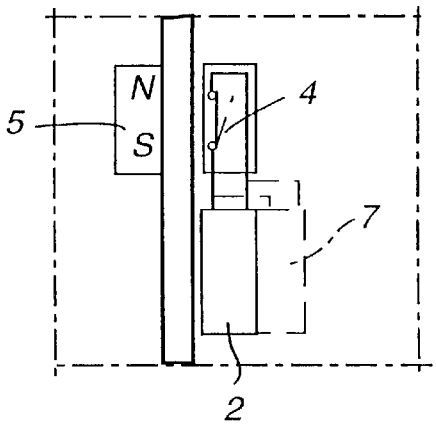
FIG. 2 illustrates the seal shown in FIG. 1.

FIG. 2 illustrates an electrical switch 4 which coacts with the information carrier 2 and which changes state, i.e. breaks a circuit, when the door 1 is opened. In the illustrated case, the switch 4 is arranged to be activated by a permanent magnet 5 mounted on the door, although other switches of a generally know kind can be used, for instance mechanical microswitches, and like devices.

Figure 3:
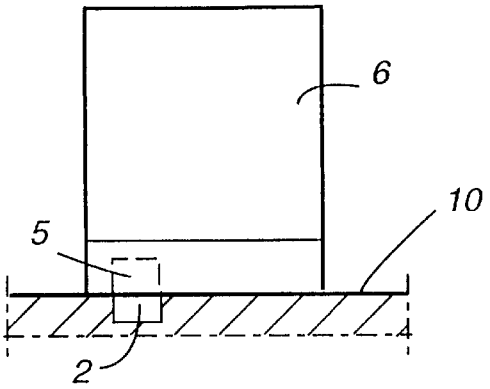
FIG. 3 illustrates schematically an object sealed in accordance with the invention.

FIG. 3 illustrates an embodiment in which the seal is used in connection with goods 6 and where breaking of the seal results from removal of the goods 6 from a predetermined place (i.e. from a position resting on surface 10. A switch 4, as in FIG. 2, is also provided.

The reference numeral 7 identifies a clock unit from which time information in the form of date and clock time can be delivered to the information carrier 2 so as to register breaking of the seal and preferably, when applicable, to reset the seal, i.e. to close the door, etc.

Figure 4:
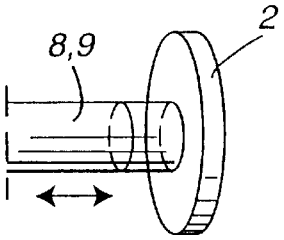
FIG. 4 illustrates schematically an information carrier and a reader unit.
Figure 5:
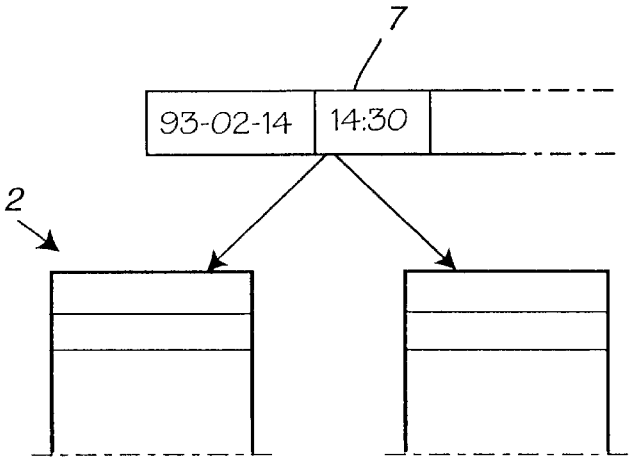
FIG. 5 illustrates schematically a clock unit for recording the times at which events concerning an inventive seal takes place.

The information carrier 2 is intended to be read by contact with a reader unit 8, FIG. 4, or in contactless cooperation with said reader unit, in which the registered information is stored and can be read therefrom, for instance for further transmission to a processing unit (not shown) where the information is evaluated.

According to one preferred embodiment, the arrangement also includes an acknowledgement unit 9, illustrated as an alternative in FIG. 4, which is intended for use in combination with the information carrier and by means of which the identity of a person breaking the seal is intended to be transmitted to the information carrier for registration. The acknowledgement unit can be combined with the reader unit 8 to form a single unit.

The method and the manner in which the inventive arrangement operates will be apparent in all essentials from the aforegoing. Breaking and, when applicable, preferably resetting of the seal (e.g. opening and closing door 1) is thus registered with the information carrier 2 in a readable manner, wherein detection, breaking of the seal, breaking and time point, breaking, time point and identity, etc., according to the different levels of detection, can be registered and thereafter read and processed.

It will also be apparent from the aforegoing that the invention provides an inexpensive, flexible and reliable seal. The invention has many different applications, e.g. sealing of offices, storage rooms, stores, etc., and can also be applied in conjunction with supervisory applications.

Although the invention has been described in the aforegoing with reference to exemplifying embodiments thereof, it will be understood that other embodiments and minor changes and modifications to the described embodiments are conceivable within the scope of the inventive concept.

For instance, the seal can be concealed in doors, door frames, etc. Neither need the seal be divided between a door and door frame for instance, as in the case illustrated in FIGS. 1 and 2, but that the seal as a whole may be concentrated in one location, such as on the door frame or the like, in which case the door itself will activate a breaker unit or the like.

Furthermore, the arrangement may be such as to enable further information to be exchanged between the information carrier and the reader unit and/or the acknowledgement unit, such as admission authorization, for instance.

The arrangement may also be constructed to produce at alarm function when the seal is broken.

The invention shall not therefore be considered restricted to the aforedescribed and illustrated exemplifying embodiments thereof, as modifications can be made within the scope of the following claims.

I claim:

1. An assembly comprising:

a door mounted in, and for movement with respect to, a door frame;

an electrical switch activated in response to movement of a portion of said door away from said door frame;

an information carrier mounted on said door frame and recording each activation of said switch;

a clock unit mounted on said door frame for suppiling a date and clock time to said information carrier for recordation thereof each time said switch is activated; and an acknowledgment unit in contact with said information carrier for transmitting the identity of a person opening said door for recordation by said information carrier.

2. An assembly as recited in claim 1 wherein said switch comprises a permanent magnet activated switch mounted on said door frame, and further comprising a permanent magnet mounted in said door for cooperation with said switch.

3. An assembly as recited in claim 2 wherein said door is hinged at a first side thereof, and wherein said magnet is mounted in a second side of said door opposite said first side.

4. An assembly as recited in claim 1 wherein said electrical switch is mounted on said door frame, and wherein said information carrier also records each deactivation of said switch.

5. An assembly as recited in claim 4 wherein said door is hinged at a first side thereof and wherein said electrical switch is mounted on said door frame adjacent a second side of said door, opposite said first side.

6. An assembly as recited in claim 1 further comprising an information carrier reader in operative contact with said information carrier.

7. An assembly as recited in claim 1 wherein said information carrier is a smart card.

8. An assembly comprising:

goods having an actuator mounted therein;

a surface having an electrical switch activated by said actuator mounted therein positioned under said actuator of said goods; and an information carrier mounted in said surface and recording each activation of said electrical switch.

9. An assembly as recited in claim 8 further comprising a clock unit for supplying a date and clock time to said information carrier for recordation thereof each time said switch is activated.

10. An assembly as recited in claim 9 wherein said switch comprises a permanent magnet activated switch, and wherein said actuator comprises a permanent magnet.

11. An assembly as recited in claim 9 further comprising an information carrier reader operative in contact with said information carrier.

12. An assembly as recited in claim 8 further comprising an information carrier reader operative in contact with said information carrier.

13. An assembly as recited in claim 8 wherein said switch comprises a permanent magnet activated switch, and wherein said actuator comprises a permanent magnet.

* * * * *